United States Patent [19]

Bastien

[11] Patent Number: 4,649,580

[45] Date of Patent: Mar. 17, 1987

[54] SEALED NECK SUPPORT FOR SHAMPOO BOWLS

[76] Inventor: Ernest J. Bastien, 362 De Anza Dr., Vallejo, Calif. 94589

[21] Appl. No.: 831,879

[22] Filed: Feb. 24, 1986

[51] Int. Cl.[4] ..... A54D 44/10; A54D 19/00

[52] U.S. Cl. ..... 4/523; 4/519; 4/520

[58] Field of Search ..... 4/520, 519, 523, 516, 4/515, 575, 661, 579, 658; 297/397–398

[56] References Cited

U.S. PATENT DOCUMENTS

| | | | |
|---|---|---|---|
| 2,172,589 | 9/1939 | Middleton | 4/523 X |
| 2,297,639 | 9/1942 | Thauwald | 4/520 |
| 2,351,849 | 6/1944 | Wells et al. | 4/523 X |
| 2,494,957 | 1/1950 | Morgan | 4/520 X |
| 2,516,601 | 7/1950 | Smalls | 4/523 X |
| 2,818,585 | 1/1958 | Campbell | 4/523 X |
| 2,948,903 | 8/1960 | Gilmer | 4/523 |
| 4,327,452 | 5/1982 | Swatzell | 4/523 |
| 4,385,408 | 5/1983 | Rhodes | 4/523 |
| 4,411,032 | 10/1983 | Lewy | 4/523 |

*Primary Examiner*—Henry K. Artis

*Attorney, Agent, or Firm*—Harris Zimmerman; Howard Cohen

[57] ABSTRACT

A neck support is installable in the wall indentation of a hairdresser's shampoo bowl or the like and defines a notch for receiving and cushioning the neck of a person whose hair is to be shampooed or otherwise administered to. A membrane extends across the notch to form a fluid leakage barrier, the membrane being an elastic material which distends to the extent necessary to enable entry of the person's neck into the notch and then remains in tight contact with the back and sides of the neck.

10 Claims, 3 Drawing Figures

FIG _ 1
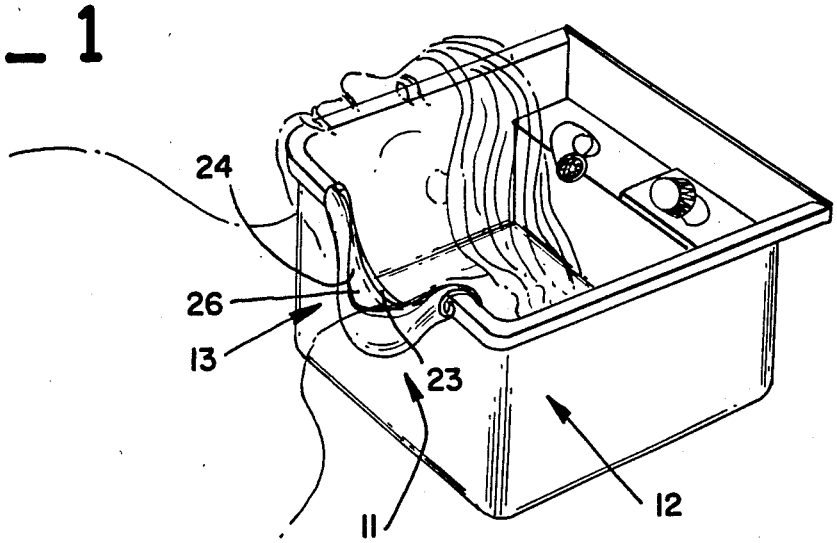
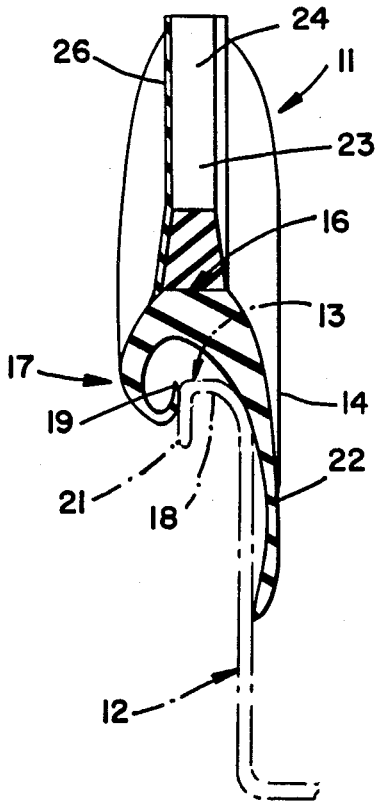
FIG _ 3
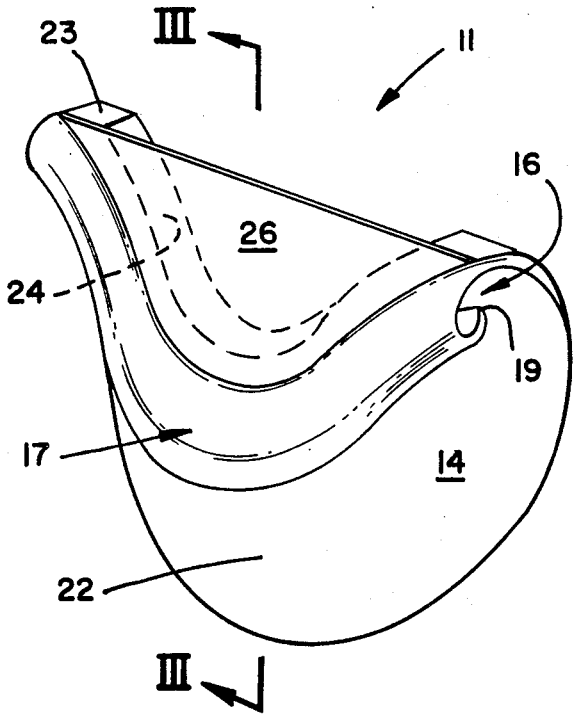
FIG _ 2

SEALED NECK SUPPORT FOR SHAMPOO BOWLS

TECHNICAL FIELD

This invention relates to equipment for facilitating hairdressing operations such as shampooing and more particularly to neck supports which are disposed at an indentation in the wall of a shampoo bowl or the like to support and cushion a person's neck while their hair is being treated.

BACKGROUND OF THE INVENTION

Persons having a professionally administered shampoo or certain other hairdressing operations usually assume a reclining or semi-reclining position with their head situated over a shampoo bowl. The shampoo bowl typically has a concave indentation in one wall through which the back of the persons neck extends. This enables the person's head to be located at a lower level in relation to the bowl and thereby avoids or minimizes spillage of liquids during the hairdressing operations.

Shampoo bowls are typically formed of hard substances such as plastic, porcelain or metal. Thus the bowl indentation does not itself provide a particularly comfortable support for the person's neck during the hairdressing operations. Temperature differences between such materials and the person's skin can also cause discomfort.

Neck supports have heretofore been designed for the purpose of alleviating the above described problems. Such supports are attached to the bowl to provide a cushioning and thermally insulative lining in the bowl indentation against which the back of the persons neck may be rested. The cushioning material has in some instances been mounted on a backing member that that is formed of less resilient material and which is shaped to extend a short distance down the front wall of the bowl and a longer distance down within the bowl to hold the neck support in place. In some cases a cover of waterproof sheeting is provided to prevent saturation of foam rubber cushioning material and to facilitate cleaning of the neck support between usages.

Shampooing or the like is made more comfortable by neck supports of the above described kind but the prior constructions do not adequately resolve still another problem associated with the use of shampoo bowls.

In particular, water or other fluids used in hairdressing tends to run out through the bowl indentation at the back and sides of the person's neck. This is itself discomforting and can soil or damage clothing. Prior neck supports do not block outward liquid flow through the bowl indentation at least to an extent that would avoid the above discussed problems.

A neck support construction that efficiently inhibits fluid leakage would be advantageous. It is also desirable that such a neck support be compact, easily cleaned and that it be inexpensive.

The present invention is directed to overcoming one or more of the problems discussed above.

SUMMARY OF THE INVENTION

In one aspect, the present invention provides a sealing neck support for a hairdresser's shampoo bowl or the like that has a forward wall with a downwardly extending indentation into which a person's neck is inserted during shampooing operations or the like. The construction includes a base member having a curved cushion region shaped for seating in the bowl indentation to form a lining and which defines a notch for enabling entry of the person's neck into the bowl indentation. The construction further includes an elastic membrane attached to the cushion region of the base member and which extends across the notch in position to form a yieldable barrier within the notch that is distendable to conform with the person's neck.

In another aspect, the invention provides a sealing neck rest for seating in an indentation in the wall of a hairdresser's shampoo bowl or the like, the neck rest having an arcuate central region proportioned to fit into the bowl indentation to form a lining in the indentation and to provide a notch into which a person's neck may be entered. The neck rest further has a front lip region that extends downward from the central region at one end of the notch and a back lip region that extends downward from the central region at the opposite end of the notch. A flexible membrane is positioned to extend across the notch to form a fluid flow barrier, the membrane being an elastic material which distends to enable entry of the person's neck into the notch.

In a more specific aspect, the invention provides a sealing neck support for seating at an indentation in the wall of a shampoo bowl, the neck support having a central cushion region with a configuration conforming to that of the bowl indentation and which defines a notch into which a person's neck may be entered. The neck support includes a front lip that is integral with the central region and which extends sidewardly and downwardly at one end of the central region and has a drain apron that is also integral with the central region and which extends sidewardly and downward at the opposite end of the central region, the drain apron being of greater area than the front lip. A lining of cushion material is secured to the central region within the notch, the cushion material being more resilient than the material of which the central region is formed. An elastic membrane is secured to the central region of the neck support and extends across the notch in position to form a barrier to fluid flow through the notch.

The membrane which extends across the notch of the neck support stretches to the extent necessary to enable entry of a person's neck into the notch but then remains in tight contact with the back and sides of the neck owing to the elasticity of the membrane material. Thus the membrane functions as a highly effective barrier to fluid leakage along the back and sides of the neck. The invention in the preferred form may be of a compact and inexpensive construction while providing a comfortable support for the neck in addition to inhibiting fluid leakage.

BRIEF DESCRIPTION OF THE DRAWINGS

FIG. 1 is a perspective view of a sealing neck support in accordance with a preferred embodiment of the invention shown installed on a shampoo bowl and in use.

FIG. 2 is a perspective view of the neck support of FIG. 1 shown detached from the shampoo bowl and in an undistended condition.

FIG. 3 is a section view of the neck support of the preceding figures taken along line III—III of FIG. 2.

DETAILED DESCRIPTION OF THE PREFERRED EMBODIMENT

Referring initially to FIG. 1 of the drawings a sealed neck support 11 in accordance with this embodiment of the invention supports and cushions the neck of a person whose hair is being shampooed or otherwise administered to at a hairdresser's shampoo bowl 12. Such bowls customarily have a concave indentation 13 in the forward wall of the bowl through which the person's neck extends during hairdressing operations at the bowl. Neck support 11 fits on to the bowl 12 at indentation 13 and is preferably removable to facilitate cleaning and to enable replacement if that becomes necessary.

Referring now to FIGS. 1 and 2 in conjunction, the neck support 11 of this example has a base member 14 formed of a molded material that is somewhat resilient and waterproof, rubber being one suitable example. Member 14 is shaped during manufacture to have an arcuate central region 16 conforming generally with the wall of the bowl indentation 13 and which is proportioned for fitting into the indentation in position to form a lining against the wall of the indentation.

Member 14 also has a front lip region 17 of arcuate configuation conforming to the outline of the bowl indentation 13 and which extends downward at the front end of the central region of member 14, the lip region being located and proportioned to cover the front surface area of the bowl 12 that is immediately adjacent to the indentation.

Many shampoo bowl indentations 13 are bounded by a flange-like projection 18 that extends a short distance outward from the body of the bowl and then extends a short distance in the downward and sideward directions. If the neck support 11 is to be used with a bowl 12 of that kind, it is advantageous if the edge 19 of the lip region 17 of member 14 is shaped and proportioned to to extend around under the edge 21 of the bowl projection 18 and back upwardly for a distance behind the projection edge 21. The lip region 17 then tends to grip the bowl projection 18 and thereby resists inadvertent displacement of the neck support 11 during use.

Member 14 further has a back or drain apron region 22 which extends downward at the back of the central region 16 and which is shaped and proportioned to lay against the inside surface of bowl 12 when the neck support 11 is installed at indentation 13. The drain apron region 22 preferably is of greater area than the front lip region 17 and extends further downward than the front lip region. This inhibits liquid leakage through the indentation 13 and increases frictional resistance to displacement of the neck support 11.

When the member 14 is formed of resilient material such as rubber, it is advantageous if the spacing of the front lip region 17 and back drain apron region 22 is slightly smaller than the length of the bowl projection 18. The member 14 must then be expanded slightly in the course of installation. Owing to the elasticity of the member 14 material this results in a gripping action which aids in holding the neck support 11 in place and which also provides a positive sealing action between the underside of the neck support and the bowl 12 surfaces which it contacts.

It is economical and advantageous for the other reasons discussed above to form the member 14, including regions 16, 17 and 22, as a single integral element of rubber or the like. It should be recognized that variations are possible as the member 14 can also be fabricated by joining separately formed parts that may include other materials.

Member 14 provides a certain degree of padding at the base and sides of the bowl indentation 13 and also has a thermally insulative effect. For optimum comfort an additional lining 23 of a more compressible resilient material is also provided, foam rubber being one suitable example. The compressible lining 23 has an arcuate configuration conforming to that of the central region 16 of member 14 and extends along the upper surface of the central region. The lining 23, which preferably has a base as broad as the bowl projection 18, is secured to member 14 by adhesive for example.

The central region 16 of member 14 and lining 23 define a notch 24 through which a persons neck may extend during shampooing operations or the like and the construction provides a comfortable rest for the neck. In order to block the flow of liquids out of bowl 12 along the back and sides of the neck, an elastic membrane 26 is provided which extends across the notch 24 to form a flow barrier.

Membrane 26 has a linear upper edge 27 which extends across the uppermost region of notch 24. The lower edge 28 of the membrane 26 has a configuration conforming to that of the central region 16 of member 14 and is secured to member 14 and preferably to lining 23 as well with an adhesive or the like. The membrane 26 is formed of a waterproof material of very high elasticity such as thin sheet rubber for example.

In operation, with reference again to FIG. 1, the neck support 11 is fitted on to bowl 12 at bowl indentation 13 in the manner hereinbefore described. The head of the person whose hair is to be shampooed or otherwise treated is positioned over and partly within the bowl 12. This requires that the person's neck be lowered into notch 24 of the neck support 11 after which the neck rests comfortably on lining 23 which compresses in response to the weight.

Membrane 26 distends and stretches to the extent necessary to accommodate to the entry of the neck into notch 24. Thereafter, the elasticity of the membrane 26 material acts to hold the membrane in tight contact with the back and sides of the neck. In that condition the membrane 26 provides a very effective sealing action which inhibits the flow of liquids from the bowl 12 through notch 24. Upon lifting of the person's neck from the neck support 11, elasticity restores the membrane 11 to the original configuration depicted in FIG. 2.

It will also be understood that with the structure described, when the head of the person is raised in order to shampoo the base of the neck, the membrane and remaining structural parts will prevent water from running down the back of the person and direct excess water back into the bowl. The flow line of the bowl is thus extended beyond its normal limits.

While the invention has been described with respect to a particular preferred embodiment for purposes of example, many variations of the structure are possible and it is not intended to limit the invention except as defined in the following claims.

I claim:

1. A sealing neck support for use with a hairdresser's shampoo bowl, wherein the bowl has a forward wall with a downwardly extending indentation into which a person's neck is inserted during shampooing operations, comprising:

a base member having a curved cushion region shaped for seating in said bowl indentation to form a lining thereat and which defines a notch for enabling entry of said person's neck into said bowl indentation, and an elastic membrane attached to said cushion region of said base member and extending across said notch in position to form a yieldable fluid barrier within said notch that is distendable to conform with said person's neck.

2. The sealing neck support of claim 1 further including a supplemental lining secured to said curved cushion region of said base member within said notch, said supplemental lining being a material that is more compressible than the material of which said base member is formed.

3. The sealing neck support of claim 1 wherein said base member further includes a front lip region and a back lip region which extend downwardly from said cushion region at the front and back ends respectively of said notch.

4. The sealing neck support of claim 3 wherein said back lip region of said base member extends further downward from said cushion region than said front lip region.

5. The sealing neck support of claim 3 wherein the edge of said front lip region of said base member is curved to extend under said cushion region and then upwardly thereunder.

6. The sealing neck support of claim 1 wherein said base member is an integral element formed of resilient material and further includes a back lip region extending downward from said central cushion region at the back of said notch and a front lip region extending downward for a smaller distance from said central cushion region at the front of said notch, said front lip region having an outer edge with extends towards said back lip region beneath said central cushion region.

7. The sealing neck support of claim 6 wherein said elastic membrane is positioned to extend across the front end of said notch above said front lip region of said base member.

8. The sealing neck support of claim 7 further including a supplemental lining situated above said central cushion region of said base member and being secured thereto, said supplemental lining being behind said elastic membrane and being a material which is more compressible than the material of said base member.

9. A sealing neck rest for seating in an indentation in the wall of a hairdresser's shampoo bowl, said neck rest having an arcuate central region proportioned to fit into said bowl indentation to form a lining therefor and which forms a notch into which a person's neck may be entered, said neck rest further having a front lip region that extends downward from said central region at one end of said notch and a back lip region that extends downward from said central region at the opposite end of said notch, and a membrane positioned to extend across said notch and to form a fluid flow barrier therein, said membrane being an elastic material which distends to enable entry of said person's neck into said notch.

10. A sealing neck support for seating at an indentation in the wall of a shampoo bowl, said neck support having a central cushion region with a configuration conforming to that of said bowl indentation and which defines a notch into which a person's neck may be entered, said neck support further having a front lip that is integral with said central region and which extends sidewardly and downwardly therefrom at one end of said central region and having a drain apron that is also integral with the central region and which extends sidewardly and downward therefrom at the opposite end of the central region and which is of greater area than the front lip, a lining of cushion material secured to said central region within said notch which cushion material is more resilient than the material of which said central region is formed, and an elastic membrane secured to said central region and extending across said notch in position to form a fluid flow barrier therein.

* * * * *